United States Patent [19]

Bergman et al.

[11] 4,019,563

[45] Apr. 26, 1977

[54] METHOD AND APPARATUS FOR CONTROLLING THE BATCHING OF A MELT FOR PRESSURE TAPPING FURNACE

[75] Inventors: Kjell Bergman; Lars Carlsson, both of Vasteras, Sweden

[73] Assignee: ASEA Aktiebolag, Vasteras, Sweden

[22] Filed: Nov. 7, 1975

[21] Appl. No.: 629,990

[30] Foreign Application Priority Data

Nov. 11, 1974 Sweden ..... 7414101

[52] U.S. Cl. ..... 164/155; 222/590, 222/595

[51] Int. Cl.[2] ..... B22D 37/00; B22D 39/00

[58] Field of Search ..... 164/4, 154, 155, 156; 222/595, 1, 14, 76, 394, 399, 590

[56] References Cited

UNITED STATES PATENTS

| | | | |
|---|---|---|---|
| 3,396,870 | 8/1968 | Diamond et al. | 222/595 X |
| 3,465,916 | 9/1969 | Hibbard et al. | 222/595 |
| 3,504,825 | 4/1970 | Diamond et al. | 222/595 X |
| 3,834,587 | 9/1974 | Bengt et al. | 222/56 |

*Primary Examiner*—Robert B. Reeves
*Assistant Examiner*—David A. Scherbel
*Attorney, Agent, or Firm*—Kenyon & Kenyon Reilly Carr & Chapin

[57] ABSTRACT

Apparatus for batching a metal melt such as steel from a pressure tapping furnace in which a level measuring device is provided for measuring the melt level in the tapping spout and using that level to calculate a signal for terminating the batching which is dependent on the integral of melt flow, and the rate of change of melt flow so as to take in to account the double draining which occurs after the termination of batching is initiated.

16 Claims, 6 Drawing Figures

H
72
16
37
19
ΔP
19a
Pref
13
36
65
28
12
35
63
ΔP
52
51
25
Href
10
ΔHf
53
Href0
54
(dH/dt)ref
8
9
9a
26
6
P
7
H
24
5
1
21
20
2
3
4
H
14
27
67
69
38
15
71
17
M
ΔHf
18
55
28
29
56
30
58
59
Wref
57
30b
61
31
19a

METHOD AND APPARATUS FOR CONTROLLING THE BATCHING OF A MELT FOR PRESSURE TAPPING FURNACE

BACKGROUND OF THE INVENTION

This invention relates to apparatus for batching an iron or steel melt or the like from a pressure tapping furnace in general and more particularly to an improved control system for accurately controlling such batching.

Apparatus for the control of batching from a pressure tapping furnace is disclosed in U.S. Pat. No. 3,834,587. The device disclosed therein is an automatic control device operating with a pressure tapping furnace having an associated batching ladle. Its operation depends on weighing the batching ladle to determine when to terminate batching. The disclosed apparatus is arranged to deliver an output signal, from the measured weight, which gives an indication of melt flow. The signal representing melt flow along with a signal representing a desired value is supplied to a comparator with the output signal of the comparator terminating tapping when the two are equal. Although this type of apparatus operates quite well, there are applications where it is desirable to avoid weighing of an intermediate level in a ladle. For example, such an arrangement takes up a fairly large amount of space and can complicate the process in many instances. In view of this, the need for an improved method of controlling batching so that tapping is terminated at just the right point becomes evident.

SUMMARY OF THE INVENTION

The present invention provides such an apparatus. The present invention is based on fact that the melt flow is dependent on the level of the melt in the tapping spout. Starting with this point, it is possible to develop signals which represent the integral of the melt flow and the rate of change of the melt flow. In accordance with the present invention, these signals along with additional signals are developed and used to initiate termination of the batching process. In other words, rather than using a weight signal as in the prior art a direct level is used. As will become evident from the detailed discussion below the equation used for terminating the batching includes not only the integral of melt flow i.e, an indication of the total weight of melt and the rate of change of melt flow but other factors which come into play. More specifically, the integral of the melt flow, the melt flow and the derivitive of the melt flow are each determined and added together along with predetermined constants to give an approximation of the total weight which will be present at the termination of the batching after all melt has flowed out of the spout. This signal is compared with a reference representing the desired weight and, when the two are equal, the termination of the batching process is initiated. In this manner, the exact desired weight is obtained in the casting box. The present invention provides a simple control means which is suitable in many different environments such as steel mills, foundaries and the like.

DETAILED DESCRIPTION OF THE PREFERRED EMBODIMENT

Figure 1:
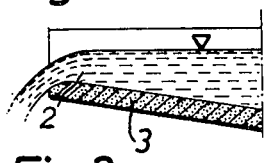
FIGS. 1 and 2 illustrate, in cross section, two possible embodiments of a tapping spout.
Figure 2:
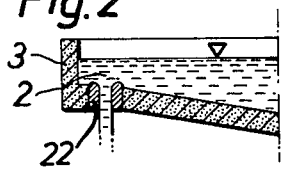
Figure 5:
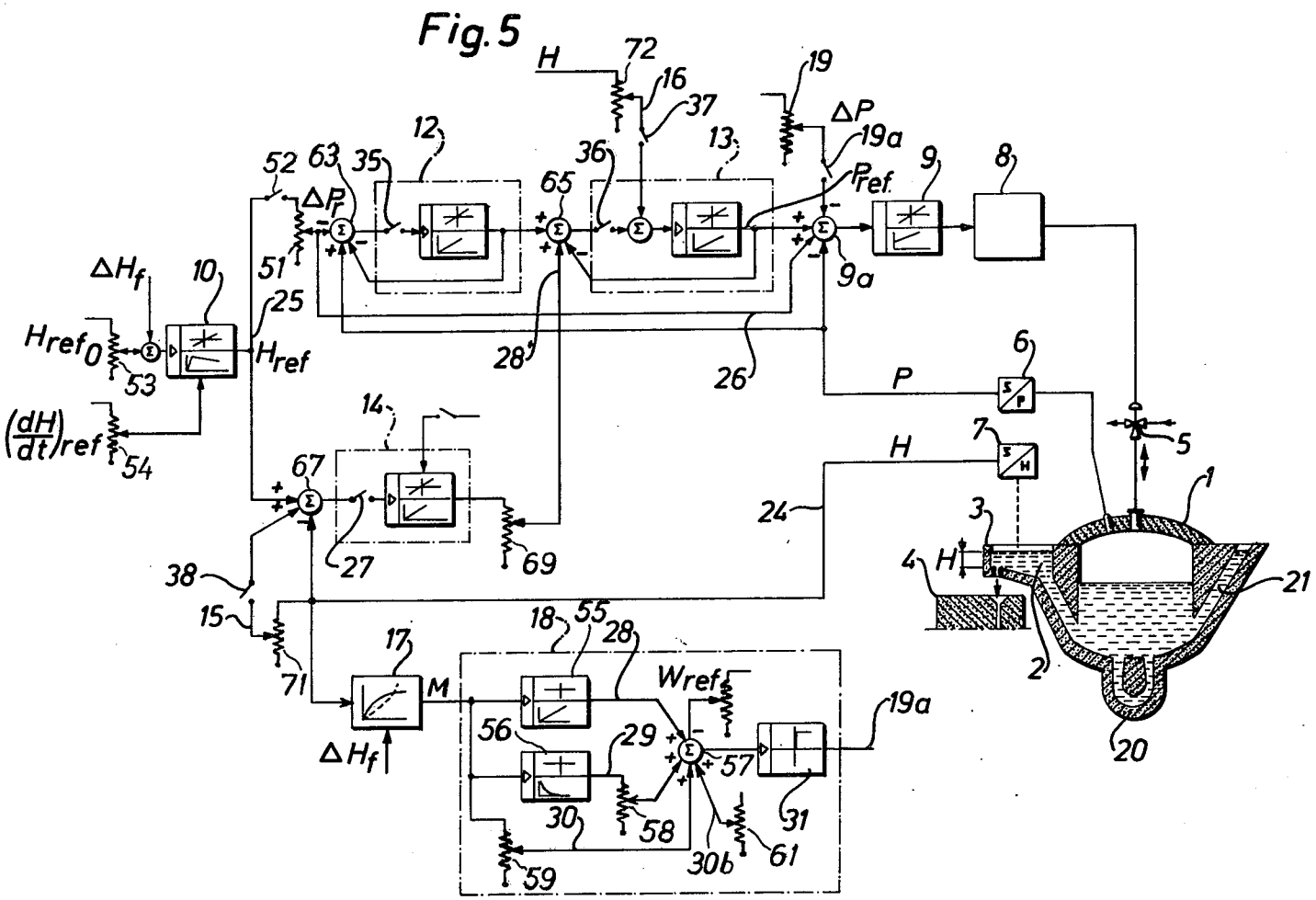
FIG. 5 is a circuit diagram illustrating the control system of the present invention.

With reference to FIG. 5, there is seen a pressure tapping furnace 1 having a pressure inlet controlled by valve control means 5. This furnace is of the type having an inductor unit of the channel type indicated at 20 and is what is commonly known as a teapot furnace. It has an inlet at 21 and an outlet with a tapping spout designated 3. Tapping of the furnace is accomplished by supplying a gas under pressure to the space above the melt within the furnace, the gas pressure being controlled by the valve arrangement 5. Means 6 are provided for measuring the pressure in the furnace and providing a voltage output proportional thereto. The pressure within the furnace is designated herein as P. FIGS. 1 and 2 show tapping spouts in more detail. FIG. 2 illustrates a tapping spout of the same type shown on FIG. 5. Of significance at this point is the fact that each of these tapping spouts has a threshold level 2. If the melt is below that threshold level it is not free flow from the tapping spout but when that level is exceeded it will flow either over the lip as in FIG. 1 through the outlet e.g. 22 as in FIG. 2.

Also shown on FIG. 5 is a casting gate or casting box 4. During casting it is desirable to batch a correct, predetermined amount of melt of a metal such as iron or steel into the casting box without unnecessary melt in the gating system. To do so requires that the melt flow from the furnace be stopped at exactly the right time. One typical manner of stopping casting, and the method used in the present invention, comprises reducing the pressure in the furnace so that the level in the tapping spout 3 falls below the threshold 2. However, it is evident that this decrease in pressure will not result in an immediately termination of flow. Typical characteristic curves for the height of the melt in the spout 3 are shown on FIG. 6. As illustrated, the level after being brought near a level of Hl, is controlled about that level. Hl is the level at which tapping is assumed to be terminated i.e. the point where the pressure is decreased. It is evident from the figure that not only the level H of the melt at that point but the rate of change of level will have an effect on the ultimate amount of melt which reaches the casting box. Between the time tl when the pressure is reduced and the time when the level falls below the threshold, represented by the X axis, additional draining into the casting box takes place. This is often referred to as double draining and must be taken into account. From the figures it becomes quite evident that the nature of the double draining depends not only on the height of the melt in the spout at the time tl but also on the rate of the change of that level dH/dt. As noted above, the rate of flow of the melt or simply melt flow is a function of the level H. Thus, for a given H, a given melt flow will be obtained. The weight of melt which reaches the casting box will be determined in the first instance by the integral of this flow from the beginning of tapping until the time tl. The double draining which will add additional weight to the melt which is tapped is a function of the level H remaining in the spout when the pressure is reduced and the rate of change of that level. Of course, these factors also directly relate to corresponding quantities of melt flow. In other words the ultimate amount of melt which ends up in the casting box depends on the melt flow at the time pressure is reduced and the rate of change in the melt flow at that point. Thus, in order to accurately tap a desired amount of melt is it necessary to take into account the integral of the melt flow from the beginning of tapping till the time of pressure reduction, the level or melt flow existing at that time, and the rate of change of level or melt flow at that time.

Figure 6:
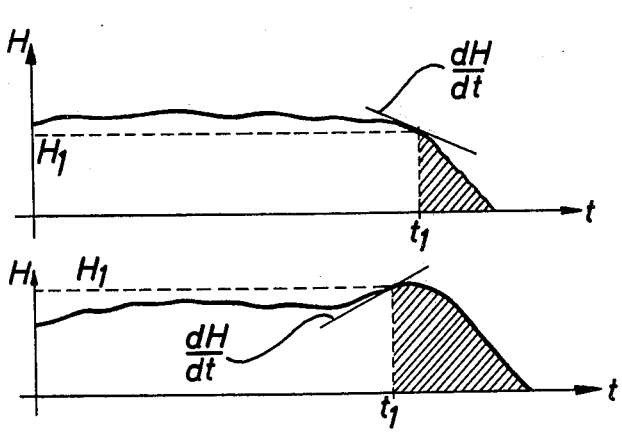
FIG. 6 illustrates two tapping curves and is useful in understanding the relationship between the level, rate of change of the level and the amount of melt which is batched.

As indicated above, at a time te, corresponding to tl on FIG. 6, the pressure in the furnace is reduced by a quantity $\Delta$ P to ultimately bring the level H in the spout 3 below the threshold 2. Taking into consideration the factors noted above the final weight of melt which will be cast can be expressed as follows:

$$w = \int_0^{t_e} \dot{M}(t)dt + k_1 \cdot \dot{M}(t_e) + k_2 \frac{d\dot{M}(t_e)}{dt} + k_3$$

where $\dot{M}$ is the melt flow rate and $\dot{M} = f(H)$. From this expression, the point at which pressure should be reduced to give a desired weight can be described as follows:

$$w_{desired\ value} - \int_0^{t_e} \dot{M}(t)dt + k_1 \cdot \dot{M}(t_e) + k_2 \frac{d\dot{M}(t_e)}{dt} + k_3 = 0$$

The expression $\dot{M} = f(H)$ indicates that for a given construction of tapping spout 3 of the furnace, melt flow is dependent on the melt level above the opening 22 of FIG. 5, for example. Similarly in an open tapping channel such as that of FIG. 1 an equivalent relationship can be determined. Furthermore, the same principal may be applied even where a stopper rod is used as in FIG. 3. FIG. 5 illustrates, in block-circuit diagram form, the control system of the present invention. As indicated above, means 6 are provided to sense the pressure P in the furnace and provide an output signal proportional thereto. In general terms, it is desired to maintain pressure at a predetermined value so as to maintain a desired level H in the tapping spout during tapping. The desired pressure includes a nominal pressure level which is stored in an analog memory device 13 and which is provided as one input to a summing junction 9*a*. The second input to the summing junction is a quantity $\Delta P_r$ obtained from a potentiometer 51 which is coupled through a switch 52 to a ramp generator 10. The ramp generator 10 has as inputs a reference level $H_{ref_u}$ from a potentiometer 53 and a desired rate of change of level from a potentiometer 54. On its output line 25 it provides a ramp signal which is the desired tapping profile. This device is essentially equivalent to the ramp generator described in the aforementioned U.S. Patent. The signal $\Delta P_r$ from the potentiometer 51, and the signal $P_{ref}$ from the analog memory 13 are differenced at the summing junction 9*a* with the measured value P. The error signal obtained provides an input to a proportional integral controller 9 i.e. an operational amplifier having capacitive feedback. Controller 9 in accordance with this input will change its output level until the pressure within the furnace or tundish is exactly that which is the sum of $\Delta P_r$ and $P_{ref}$. This output is provided to a switching device 8 which controls the control valve 5 to regulate the pressure within the furnace. The manner in which the signal is stored in the analog memory 13 is obtained will be described in more detail below. The signal for terminating batching i.e. the signal $\Delta$ P, which causes the level in the furnace to be reduced below the threshold is also provided to the summing junction 9*a*. This signal is developed at a potentiometer 19 and is coupled through a switch 19*a*. As indicated this subtracts from the desired pressure causing a reduction in the control output.

Thus, when tapping begins switch 19*a* is opened and the ramp generator 10 is caused to generate the desired ramp. This signal $H_{ref}$ is provided through the closed contacts of the switch 52 to the potentiometer 51 where it used to obtain a signal $\Delta P_r$. Note, that the level H and pressure are essentially directly proportional. This signal along with the stored value $P_{ref}$ are summed and compared with the pressure P fed back from the furnace to cause the controller 9 to operate the switching means 8 to maintain the desired pressure within the furnace raising the level H above the threshold 2 and causing batching from the spout 3 into the casting box 4 to take place.

Figure 4:
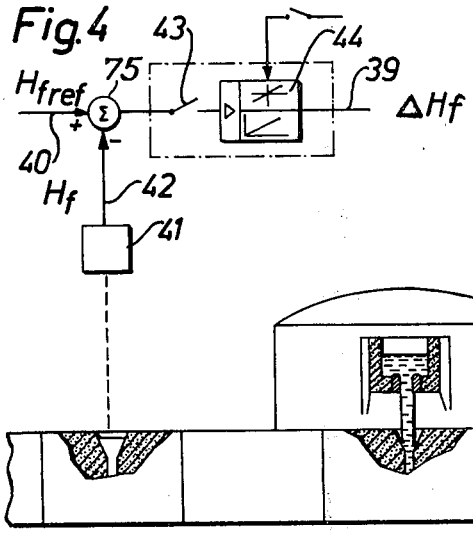
FIG. 4 illustrates a modification of the present invention in which the level in a casting box is used to generate a correction signal.

Associated with the spout 3 is a level measuring device 7. This level indicator may be a laser type device such as that disclosed in Swedish Pat. No. 327,260 or may be an X-ray type, conventional electromagnetic type, contact type or any other commonly used measuring device. It provides an analog output signal, designated H, representing the level within the casting spout throughout casing. This output on line 24 is provided as an input to a function generator 17. This function generator and other points throughout the system have an additional input $\Delta H_f$ which will be explained in more detail in connection with FIG. 4 below. For the moment it can be assumed that these additional inputs are not present. As noted above, there is a direct relationship between the level H and the melt flow $\dot{M}$ function generator 17 implements this function. In well known fashion, a curve relating the rate of melt flow to the level H can be constructed using experimental data. This curve can then be approximated with straight line segments with the intersection of the line segments defining break points. Once these break points are established, a diode function generator can be constructed using well known techniques. Thus, the output of the function generator will be an analog quantity representing the melt flow $\dot{M}$. This is provided as an input to a computing apparatus 18. Included therein is an integrator 55 which provides on its output line 28 the integral of $\dot{M}$. Also included is a differentiator 56 which provides on its output the $d\dot{M}/dt$. The integral is fed directly to a summing junction 57. The differential on line 29 is coupled through a potentiometer 58 which is used to multiply to the constant $k_2$ of equations of 1 and 2 above. The quantity $\dot{M}$ is also provided through a further potentiometer 59 to provide the quantity $k_1 \dot{M}$. Finally, there is a potentiometer 61 providing an output on line 30*b* representing a constant $k_3$. These four terms, the four terms of equations 1 and 2 above are summed at the summing junction 57. Subtracted from this quantity is a quantity $W_{ref}$ which represents the desired weight. Thus, until the desired weight is reached, the output from the summing junction will be negative but when the sum of the terms of equation 1 become equal to $W_{ref}$ output will become 0. Coupled to the summing junction is a comparator 31 arranged to change its output when its input goes from a negative to a 0 level. Thus, at the point where this occours an output appears on line 19*a* which is used to control the switch 19*a* associated with Δ P. The switch is closed causing the pressure in the furnace to be immediately reduced. Upon reduction, the double draining takes place, and since the level and the rate of change of level at the time of pressure reduction were taken into account, when double draining is finished the exact, desired amount of melt will have been batched.

It can be seen, that this system will operate no matter what level is present in the spout 3 as long as it above the threshold. However, it is desired to maintain this level 3 at a predetermined point to carry out casting at a desired rate. Thus, it is necessary that proper pressure be maintained within the furnace during batching. As noted, pressure is measured by a measuring device 6. This quantity is fed back to a summing junction 63 in a positive sense, at which junction it has subtracted from it the quantity $\Delta P_r$. [Note this quantity is added back to the desired level at the summing junction 9*a*.] The difference between these two values is the input to an analog memory device 12. Analog memory device 12 has a sampling switch 35. While batching is in progress, the switch 35 is closed. Thus, the analog memory 12 will take on the value of pressure existing during that batch. On the termination of batching, the switch is opened and this value is transferred through a summing junction 65 and a closed switch contact 36 to the analog memory device 13 storing the value $P_{ref}$. This, the value $P_{ref}$ for a given batch is determined, initially, by the pressure which existed during the previous batch. Ideally, the level H will follow exactly the level $H_{ref}$. However, such does not always occur. To take this into account, the value $H_{ref}$ is provided to a summing junction 67 where it is compared with the actual value H on line 24. During batching, the switch 27 is closed so that the difference over batching can be formed. In other words the circuit 14 forms a correction signal. This correction signal will be held in the circuit 14, which is a memory device or sample and hold circuit, once the switch 27 is opened at the end of batching. A portion of this signal is fed through a potentiometer 69 to the summing junction 65 over line 28 where it is added to the pressure value stored in the analog memory 12. Thus the stored value of pressure existing during the last batch has added to it a correction signal indicating the error in level which resulted from that pressure. After batching, the switch 36 is closed and this value i.e. the previous pressure plus the correction signal is transferred to the analog memory 13 for the use in the next batch.

Figure 3:
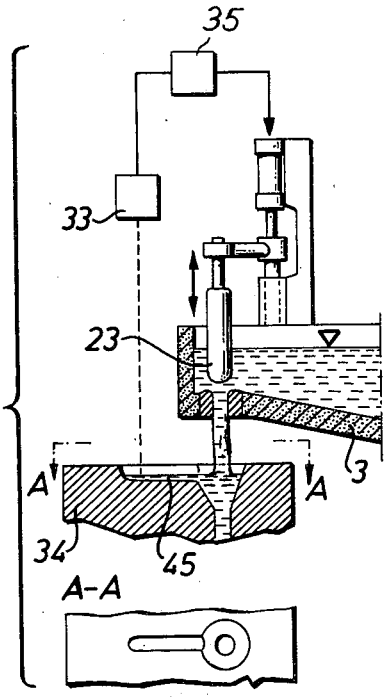
FIG. 3 illustrates a different type of tapping spout utilizing a control rod.

It will be recognized for those skilled in the art that as the level in the furnace decreases during batching the relationship between the pressure and the level H will change. For this reason, a further correction signal is provided both to the correction circuit 14 and to the analog memory 13. In each case, this signal is a portion of the signal H coupled through a potentiometer. Thus the signal H on line 24 is coupled through the potentiometer 71 and a switch 38 to the summing junction 67. Similarly this signal is coupled through a potentiometer 72 having an output on line 16 and through the switch 37 to a summing junction at the analog memory 13. These signals are provided with their associated switches 37 and 38 closed during batching to compensate for the level change taking place. With this exception, through the use of the analog memory 13, any changes or correction in the reference pressure are made only between batches and not during batching.

Where an arrangement such as that of FIG. 3 is present, the control signal developed on the line 19*a* may be used to control the stopper rod 23 rather than for pressure control. In such an arrangement, the control signal on line 19*a* will be used as a signal to drive the stopper downward and close off the opening. If an arrangement of this nature is used over a long period of time, a change in the size of the tapping hole can result. As a result in a relationship between $\dot{M}$ and H will be changed. In order to correct for this, a measurement of the level in a previously cast flask may be used. This is illustrated on FIG. 4. As shown thereon, the apparatus is casting into one flask with a previously cast flask [with one flask between ] having coupled thereto measuring apparatus 41. This apparatus which may be similar to apparatus 7 described above, develops an output signal $H_f$ on a line 42 representing the height of the metal cast. This signal is compared at a summing junction 75 with a signal $H_{ref}$ on 40. The difference is coupled through a switch contact 43 to a sample and hold circuit 44 providing an output on line 39 which is the quantity $\Delta H_f$ shown on FIG. 5. This correction signal is then provided to the function generator 17 and as an additional input at the ramp generator 10 to take into account these changes which occur during casting over a long period of time. The circuit 44 which is sample and hold circuit or analog memory circuit can include an integrating amplifier for that purpose. The circuits 12, 13 and 14 can be constructed in similar fashion. In each case, it is noted that there is a switch associated with the circuit for the transfer of data. The circuits 12 and 13 have negative feedback directly to their input summing junction and will thus take on the value at their input when the switch is closed and hold it when the switch is opened. The circuits 14 and 44, however do not have this feature. Thus, they are each shown as having associated therewith an additional switch used for resetting in conventional fashion i.e. in typical fashion the feedback capacitor in the integrating amplifier will be shorted by a switch such as a FET switch to reset the integrator to zero in preparation for the next sampling.

Alternatively, the signal $\Delta H_f$ developed on line 39 may be used to control the position of the stopper 23 when in the open position and in that manner compensate for variation in a relationship between the melt flow and the level.

It is also possible to adapt the system of the present invention to the system noted in U.S. Pat. No. 3,834,587. In such a case, rather than measuring level and developing a flow rate thereform, the intermediate ladle is weighed and from the weight signals the melt flow $\dot{M}$ is obtained. Once obtained, this quantity can be used in the manner shown in FIG. 5 in the computing apparatus 18 to determine when to terminate batching.

FIG. 3 also illustrates another alternative to the apparatus of the present invention. As shown, a special channel 45 is provided to give an indication of a full box 34. The melt flow during batching is controlled such a manner that under no circumstances will it fill the channel before the box is filled. Means 33 are provided i.e. a level meter of the type noted above to determine when melt begins to flow into the channel at which point the illustrated control 35 is operated to bring the stopper down to terminate the flow. Again, batching stops at exactly the right moment.

Thus, an improved control system for batching a pressure tapping furnace has been shown. Although specific embodiments have been illustrated and described, it will be obvious to those skilled in the art the various modifications without departing from the spirit of the invention which is intended to be limited solely by the appended claim.

We claim:

1. Apparatus for batching a metal melt such as steel from a pressure tapping furnace having a tapping spout, the level in the tapping spout being controlled by the pressure in the furnace, and the melt flow from the tapping spout being a function of said level comprising:

a. means for measuring the level of the melt in the tapping spout and providing a first signal proportional thereto;

b. function generating means having said first signal as an input and providing a second signal proportional to the melt flow;

c. means for integrating said second signal to form a third signal;

d. means for computing the rate of change of said second signal to form a fourth signal e. means for summing said second, third and fourth signals along with a constant reference signal to provide a sum signal;

f. means for initiating termination of batching when said sum signal reaches a predetermined value.

2. Apparatus according to claim 1 and further including a closed controlled loop for the pressure control of the furnace.

3. Apparatus according to claim 2 wherein said closed loop control system includes:

a. means for establishing a fifth signal representing a desired pressure in said furnace;

b. means for measuring the actual pressure in said furnace and providing a sixth signal proportional thereto;

c. control means responsive to the difference between said fifth and sixth signals for controlling the pressure in said furnace.

4. Apparatus according to claim 3 wherein said means for developing said fifth signal comprise a first memory circuit, storing a seventh signal, means for developing an eighth, level reference signal and means for summing the output of said first memory circuit and said eighth signal.

5. Apparatus according to claim 4 and further including a second memory circuit having coupled to its input during batching said eighth signal and said sixth signal from said furnace for storing a value representing their difference during a batching cycle.

6. Apparatus according to claim 5 and further including means for transferring the value in said second memory circuit to said first memory circuit between batching.

7. Apparatus according to claim 6 and further including means for developing a correction signal proportional to the difference between said first signal representing the actual level in said furnace and said eighth reference level signal during batching; and means to add said correction signal to the output of said second analog memory when said output is transferred to said first analog memory.

8. Apparatus according to claim 7 and further including means for correcting said closed loop control system for changes in melt level during batching

9. Apparatus according to claim 2 wherein said means for inititating termination of batching comprises means to cause said control loop to reduce the pressure in said furnace.

10. Apparatus according to claim 2 wherein said tapping spout includes a stopper rod for sealing an outlet in said tapping spout and wherein said means for terminating comprise means to initiate closure of said stopper rod.

11. Apparatus according to claim 10 and further including means for measuring the level of a finished flask, means to compare said level with a predetermined desired level to provide a difference signal representative of the difference there between; and mean coupling said difference signal to said means generating said eight, level reference signal and said function generating means.

12. Apparatus according to claim 10 and further including means for measuring a level of a finished flask; means to compare said level with a predetermined desired level to provide a difference signal representative of the difference there between; and mean coupling said difference signal to said stopper rod.

13. Apparatus according to claim 1 wherein said casting box has a channel associated therewith and further including means for detecting melt in said channel and providing an output indicative thereof and means responsive to said output to cause said stopper means to close off said opening.

14. A method for batching a metal melt such as steel for a pressure tapping furnace comprising:

a. developing a signal representing melt flow;

b. determining the integral of said melt flow signal;

c. determining the rate of change of said melt flow signal; and d. terminating batching when the sum of a predetermined constant, the melt flow, the integral of said melt flow and said rate of change of melt flow are a predetermined level.

15. The method according to claim 14 wherein said melt flow is determined as a function of the level in the spout.

16. The method according to claim 15 wherein batching is performed using an intermediate ladle and wherein said melt flow is derived from the weight of said ladle.

* * * * *